United States Patent [19]

Rosman

[11] Patent Number: 4,730,743

[45] Date of Patent: Mar. 15, 1988

[54] HYDRAULICALLY OPERATED BRIDGE CRANE

[75] Inventor: Alan H. Rosman, Woodland Hills, Calif.

[73] Assignee: Dynamic Hydraulic Systems, Inc., Canoga Park, Calif.

[21] Appl. No.: 941,330

[22] Filed: Dec. 15, 1986

[51] Int. Cl.[4] ..... B66C 17/00

[52] U.S. Cl. ..... 212/205; 92/134; 212/162

[58] Field of Search ..... 60/413; 92/134; 212/162, 163, 164, 205, 215, 216, 217

[56] References Cited

U.S. PATENT DOCUMENTS

| | | | |
|---|---|---|---|
| 1,866,801 | 7/1932 | Ferris | 212/217 |
| 2,940,608 | 6/1960 | Underwood et al. | 212/162 |
| 3,294,252 | 12/1966 | Hosoi et al. | 212/205 |
| 3,973,679 | 8/1976 | Hass et al. | 212/205 |
| 4,098,082 | 7/1978 | Packer | 60/413 |

FOREIGN PATENT DOCUMENTS

| | | | |
|---|---|---|---|
| 1068184 | 5/1967 | United Kingdom | 212/205 |

*Primary Examiner*—Joseph F. Peters, Jr.
*Assistant Examiner*—Thomas J. Brahan
*Attorney, Agent, or Firm*—Hopgood, Calimafde, Kalil, Blaustein & Judlowe

[57] ABSTRACT

A bridge-crane structure wherein major structural components to sustain loads imposed upon the span are also major functional components of hydraulically controlled hoist mechanism of the crane. Specifically, closed upper and lower elongate cylinders are rigidly laced by struts to define a bridge girder, of length corresponding to the length of the bridge; and these cylinders are charged with gas at elevated pressure and interconnected as major components of a hydraulic accumulator relied upon as a phantom counterweight in the hydraulic hoist mechanism.

16 Claims, 4 Drawing Figures

HYDRAULICALLY OPERATED BRIDGE CRANE

RELATED CASES

This application relates to hydraulic-control subject matter described in detail in my copending application Ser. No. 601,481, filed Apr. 18, 1984, and said copending application is a continuation-in-part of my original application Ser. No. 570,590, filed Jan. 13, 1984. Both said filed applications are hereby incorporated by reference.

BACKGROUND OF THE INVENTION

The invention relates to hydraulic lift mechanism and in particular to such mechanism as is required to serve intermittent alternating displacement of a load, wherein the load may be of various magnitudes within the capacity of the mechanism. Such conditions exist for hydraulically operated cranes and hoists, and the present invention is particularly concerned with bridge cranes, namely, crane constructions in which two transversely spaced parallel longitudinal rails are spanned by a travelling horizontal bridge with end-support means riding these rails, and with a hoist trolley and hook movably supported for guided movement along the bridge.

Conventionally, the bridge structure of high-capacity cranes of the character indicated comprises two spaced parallel bridge girders, joined at their respective ends by the end-support means which rides the spaced rails. Each of these girders incorporates one of two similarly spaced rails for transverse travelling displacement of a hoist carriage, and independent high-load and low-load cable-winch systems are mounted at spaced locations on the carriage. For example, a bridge crane of 100-ton capacity will typically have a first winch system and cable with hook for high loads (100-ton limit) and a second winch system and cable with hook for low loads (25-ton limit). The reason for the dual provision of high and low capacity systems is not only for economy, but also because the high-load system is necessarily relatively slow, as compared with the lifting speed of the low-capacity system. Typically, such a 100-ton crane will commit in the order of 100 tons to the weight of the carriage alone, and for a bridge of 60-foot span, the bridge-girder commitment will be in the order of 40 tons. Most of the energy required to operate the crane is thus committed to moving the crane and its hook, and the particular load represents at most less than half the energy requirement to operate the crane without a load. Typically, for a high duty-cycle crane, the 100-ton winch system will operate at 18 feet per minute, and the 25-ton winch system will operate at 30 feet per minute. Furthermore, inertia throughout each of the lift systems, being electric-motor driven through substantial reduction gearing, compels major time consumption for the acceleration phase and for the deceleration phase of any given lifting or descending operation, regardless of whether or not loaded at the involved hook.

BRIEF STATEMENT OF THE INVENTION

It is an object of the invention to provide improved bridge-crane structure, inherently avoiding limitations and deficiencies of prior constructions.

It is a specific object to achieve the above object in a counter-balanced hydraulically operated system which specifically avoids reliance upon dual hoists in a high-capacity situation and which also avoids the use of winches, reduction gears and associated mechanical brakes.

Another specific object is to provide an improved bridge-crane system adapted for high duty-cycle use and affording materially improved facility of use, greater access to area beneath the two-component sweep of crane displacement, and economy of power consumption and weight for a given load rating.

It is also a specific object to provide hydraulic control mechanism meeting the above objects and adaptable, both to new bridge-crane installations and as a conversion of installed existing systems.

Another specific object is to provide precise single-lever control of load elevation and of the speed of load elevation and/or descent, in hydraulically operated hoist mechanism meeting the above objects and regardless of the instantaneous magnitude of the load, within the lift capacity of the system.

Still another object is to provide a high-capacity bridge crane system which can be equally well served by a single hook suspension, regardless of load within the capacity of the system.

The invention achieves the foregoing objects in hydraulic-lift mechanism which employs what I term a power integrator in the connection between a charged hydraulic accumulator and the actuator for a vertically positionable load; the power integrator, additionally, has a prime-mover connection, and the pressurized charge of the accumulator is advisedly set to fully accommodate a preselected level of average load upon the actuator. The hydraulic circuit importantly includes check valves, with a pilot-operated check valve interposed between the the power integrator and the accumulator and another pilot-operated check valve interposed between the power integrator and the load actuator. The pilot-operated check valves cooperate with other check valves to assure automatic transfer of hydraulic fluid under pressure from the accumulator to the load actuator, and vice versa, as may be determined by selected control of or via the power integrator. The system of check valves also co-operates with pump action associated with rotation of the power integrator, to assure that adequate fluid is drawn from a sump and is deliverable for pilot-operated functions; stated in other words, with minimum reliance upon the sump, the system provides maximum conservation of energy in effecting such transfer of pressurized hydraulic fluid, from and to the accumulator, as may be involved in any controlled lift or descent of any load, within the capacity of the system.

In the present specifically disclosed bridge-crane applications of hydraulic-lift mechanism of the above nature, the hydraulic accumulator comprises elongate cylindrical steel tubing which is structually integrated into the design of the bridge. This structural tubing is closed at its ends and is gas-pressurized against the hydraulic fluid which is to be reversibly displaced with respect to a load-lifting traction cylinder. At least two such cylinders are rigidly connected to each other in vertically spaced horizontal array, extending the full span of the bridge and defining a single-girder bridge, with the upper and lower cylinders providing the high moment of inertia needed for support of the bridge and of a fully loaded trolley or carriage that is displaceable along the bridge. In the preferred forms to be described, a further horizontal cylinder completes the accumulator and is fixedly mounted to the bridge, preferably nested between the structural cylinders; in this further cylinder, a sealed movable piston isolates a gas-pressurized end from a hydraulic-fluid end, and the hydraulic capacity of this further cylinder is at least equal to the full hydraulic volume requirements of the total system, including the traction cylinder in its most-extreme actuated condition. The combined volume of the gas-pressurized end of the accumulator (i.e., in the structural cylinders and in the gas-accommodating end of the piston cylinder) is preferably in the order of ten times the hydraulic-fluid accommodating volume.

In preferred forms, the traction cylinder is also horizontal and is accommodated between the upper and lower structural cylinders. Its piston is connected to cabling which courses sheaves (1) at an end of the bridge, (2) at the trolley which is displaceable along the bridge, and (3) at the load-lifting hook suspended from the trolley.

In said copending applications, various embodiments are disclosed for different prime-mover and load situations, and also for various embodiments of manually operated and remotely operative electric control. The present detailed description of a single such system will thus be understood to be merely illustrative, and therefore not limiting. Also, the fact that bridge cranes to be described herein are in the context of spaced parallel longitudinal rails at elevation above floor level is not to be considered limiting, in that the principles of the invention are equally applicable to gantry-type cranes, wherein the ends of the bridge are structurally integrated into spaced leg framing which is adapted to travel along spaced ways at floor level.

A power integrator, as contemplated herein is a rotary liquid-displacement device having two spaced flow-connection ports and an interposed rotor with externally accessible shaft connection to the rotor, and the expression "rotary" as used herein in connection with such a device is to be understood as including various known rotary-pump structures, such as gear-pump and sliding-vane devices, as well as axially reciprocating and radially reciprocating configurations, wherein rotor-shaft rotation is related to hydraulic flow into one port and out the other port. In other words, for purposes of the invention, such "rotary" devices provide for such hydraulic flow, and they provide for an external input/output torque-response relation to the hydraulic flow.

DETAILED DESCRIPTION

The invention will be illustratively described in connection with the accompanying drawings, in which.

Figure 1:
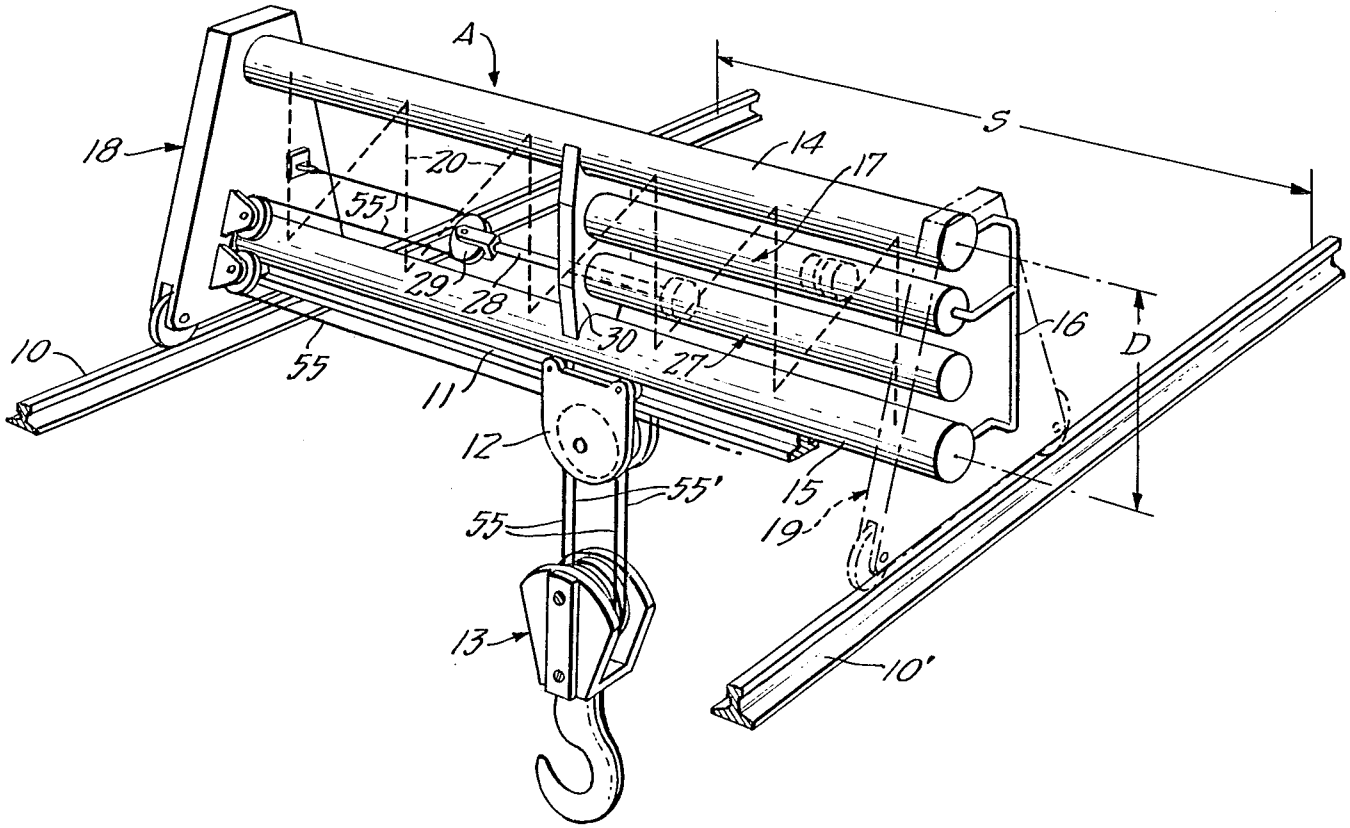
FIG. 1 is a simplified view in perspective, partly broken-away and in phantom to permit overall identification of bridge-crane structure of the invention.

In FIG. 1, the invention is shown in application to bridge-crane structure A which spans and is movably supported on fixed longitudinal rails 10-10' at spacing S, which may be the distance between rail-supporting walls of a building. Rails 10-10' will thus be understood to be at desired height above floor level of the building. Transverse rail means 11 is an integral part of the bridge structure and provides guidance for displacement of a trolley 12 for a single cable-suspended hook 13.

In accordance with a feature of the invention, the bridge A relies for its structural integrity upon closed upper and lower elongate horizontal cylinders 14-15 which extend substantially the full bridge span and which have fluid communication (16) and coact with a further, non-structural piston cylinder 17, for a hydraulic-accumulator purpose which will be explained. The structural cylinders 14-15 are at fixed spacing D, center-to-center, which is assured by integration of their respective ends to end-support means in the general nature of A-frames 18-19 having spaced wheels or trucks which ride the longitudinal rails 10-10'. And in a distributed pattern along both sides, a lacing of welded stiff connecting strut members (schematically indicated in FIG. 1 by heavy dashed lines 20 on the near side) establish such integrity of the combined structure 14-15-18-19-20 as to define a girder having symmetry about a vertical plane; in this girder structure, the cylinders contribute most significantly to a high moment of inertia for all vertical sections taken normal to said plane.

By way of illustration, for a bridge crane of FIG. 1 having a span S of 60 feet and a 100-ton load capacity, the center-to-center spacing D between cylinders 14-15 is about five feet. Cylinders 14 are each of steel tubing, 60 feet long and of 18-inch diameter. The weight of the trolley 12 and its hook 13 need be no more than 1 to 2 tons, and the weight of the described girder structure, with end members 18-19 and trolley rail 11, is 15 tons. Thus, for comparable capacity, the combined weight of all the travelling structures of FIG. 1 is far less than the combined weight of pre-existing components which the FIG. 1 structure replaces.

Figures 2, 3:
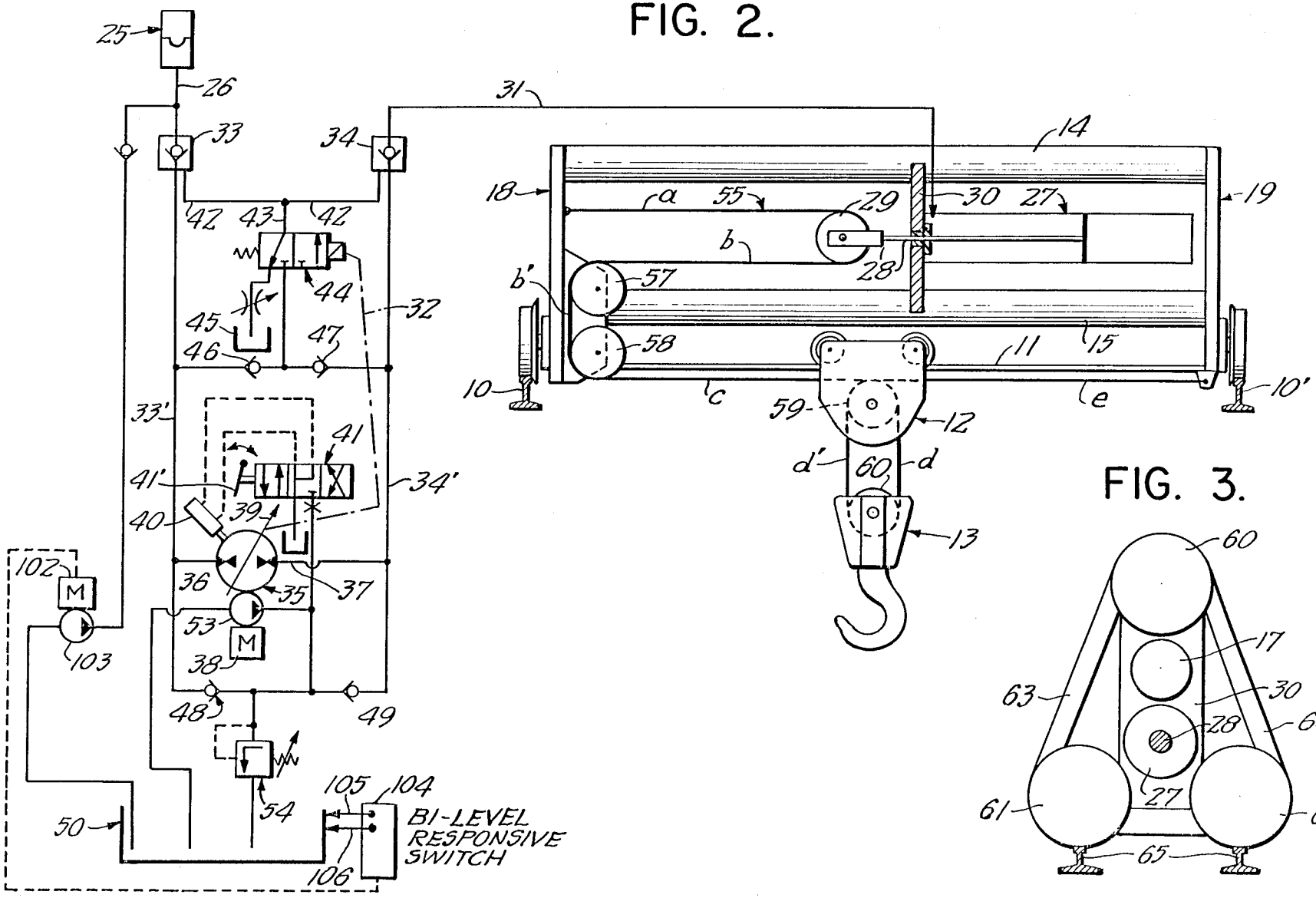
FIG. 2 is a diagram of hydraulic circuitry for the bridge crane of FIG. 1, structural components being shown schematically, to provide a more clear showing of lift cabling.
FIG. 3 is a schematic view in end elevation of an embodiment modified with respect to that of FIG. 1.

Returning now to the hydraulic accumulator and its related control circuit, additional reference is made to FIG. 2, wherein the hydraulic accumulator is schematically designated 25 and will be understood to comprise structural cylinders 14-15 as well as the piston cylinder 17. More specifically, the upper chamber (i.e., above the displaceable sealed piston) of accumulator 25 in FIG. 2 will be understood to be a schematic designation of the combined pressurized gas volumes of cylinders 14-15 and the right-hand end of the piston cylinder 17 of FIG. 1, with gas at pressure in the order of 1500 psi supplied by suitable means (not shown). The lower chamber of accumulator 25 (i.e., below the displaceable sealed piston) will be understood to be a schematic designation of the hydraulically filled and gas-pressurized other end (i.e., left-hand end) of the piston cylinder 17 of FIG. 1, with a port connection 26 for inlet/outlet flows of hydraulic fluid with respect to the accumulator 25.

The circuitry of FIG. 2 controls flows of hydraulic fluid between the accumulator 25 and a cable-actuating traction cylinder 27, having a stem 28 which will be understood to extend externally through a sealing gland (not shown) at the tail end of cylinder 17, with clevis connection via a sheave 29 to hoist cabling, to be later described. For the crane dimensions given above, cylinder 17 is illustratively of 16-inch inside diameter, 24-feet long, and its piston rod or stem 28 is of 4.5-inch diameter. Cylinder 17 is rigidly referenced by welding to the bridge-girder frame via a bulkhead 30 which is secured to upper and lower cylinders 14-15.

In accordance with the invention, the hydraulic accumulator 25, charged as above indicated, is employed as a "counterweight", continuously operative upon fluid in line 31 to cylinder 17 to effectively balance the dead load of hook 13, plus a selected live-load magnitude which is selected to be intermediate zero live load and full-rated live load, and generally one half the full-rated live load. More specifically, the port 26 for hydraulic flow to or from accumulator 25 is connected to the line 31 for hydraulic flow from or to cylinder 17 via pilot-operated check valves 33-34 oriented to check hydraulic flow from accumulator 25 and from cylinder 17 respectively, in the absence of a pilot-operated opening of one or the other of these valves 33-34; and a power integrator 35 is interposed between lines 33'-34' served by the respective check valves 33-34. The power integrator 35 is a rotary-displacement device having first and second flow-connection ports 36-37, to which lines 33'-34' are respectively connected, and an interposed rotor has externally accessible shaft connection to a prime mover which may be a reversible electric motor but which in the form shown in a unidirectional electric motor 38. The pilot-operated check valves 33-34 are preferably of the so-called barrier type. As shown in FIG. 2 (see arrow 39), the power integrator 35 is desirably a variable flow device, such as a rotationally driven variable-flow axial-piston device wherein direction and magnitude of flow between ports 36-37 is a function of swash-plate tilt in reference to a neutral (no-flow) situation wherein the swash plate is normal to the axis of driven rotation. In FIG. 2, a double-acting hydraulic actuator 40 is reversibly actuated via servo-valve means 41 which provides proportional flow delivery to actuator 40, depending on the direction and extent of control deflection at 41', away from the neutral (central) position thereof.

It is preferred that pilot opening of the respective check valves 33-34 be in response to a single actuating pressure. Thus, a line 42 establishes parallel connection of the respective pilots of check valves 33-34, and the circumstance of sufficient hydraulic pressure in a control line 43 is operative to dislodge both check valves 33-34 from their normally closed condition. This line-43 control connection additionally includes a solenoid-operated valve 44 which is normally positioned to discharge pressure fluid in line 43 to sump, symbolized at 45, but which is solenoid-actuable to enable pressure fluid in either of the integrator-port lines 33'-34' to pass via line 43 for concurrent pilot-driven opening of both check valves 33-34, there being isolation check valves 46-47 (connected back-to-back to valve 44) to assure integrity of the described pilot-operating connection 43. A control connection, symbolized at 32, will be understood to determine energized actuation of solenoid valve 44 whenever the swash plate of integrator 35 is moved from its neutral position.

Two further check valves 48-49, in separate lines 51-52 of connection to the respective port connections 36-37 of the power integrator, are operative in conjunction with a low-pressure pump 53 to assure an initial supply of hydraulic fluid from a sump or reservoir 50 to the power integrator, upon starting motor 38; pump 53 also serves continuously to supply such low-pressure hydraulic fluid as is needed for servo-valve (41) operation of the swash-plate tilt actuator 40; in the absence of delivered low pressure from pump 53, actuator 40 and the swash plate return to their neutral positions. Specifically, each of the check valves 48-49 is oriented to check or block any flow in the direction of reservoir 50, but a relief valve 54 returns to sump 50 any pumped fluid at excessive pressure.

Before proceeding with an operating description, it will be indicated that, to avoid confusion, hoist cabling is not shown in detail in FIG. 1 and that, for the same reason, only a single length of cable means 55 is shown. In actuality, however it is to be understood that multiple cables, in side-by-side parallel-connected array, are preferred, for safety and as a means of utilizing cabling of lesser diameter; in FIG. 1, such multiple use of cabling in parallel is shown only local to the hook-suspension region wherein the suspension loop of the second cable 55' is identified alongside the first cable 55. Thus, for the assumed hoist of 100-ton capacity, the single cable means 55 that is shown may be understood to signify eight similarly connected ¾-inch cables, connected in parallel and having identical, side-by-side courses.

As shown, one end of cable means 55 has fixed connection at 56 to the end-frame member 18 which faces the tail end of traction cylinder 27. Cable means 55 runs a horizontal first course a from 56 to traction-cylinder connection via sheave 29, a second course b-b' to and around upper and lower frame-mounted sheaves 57-58, a third horizontal course c to a first trolley sheave 59, a looped vertical suspension fourth course d-d' down around the hook sheave 60 and back around a second trolley sheave (behind sheave 59), and a horizontal fifth course e to fixed connection of its other end to the end-frame member 19. Hydraulically driven retraction of traction rod 28 elevates hook 13 and its load, whatever the position or movement of trolley 12 on its track.

Figure 2A:
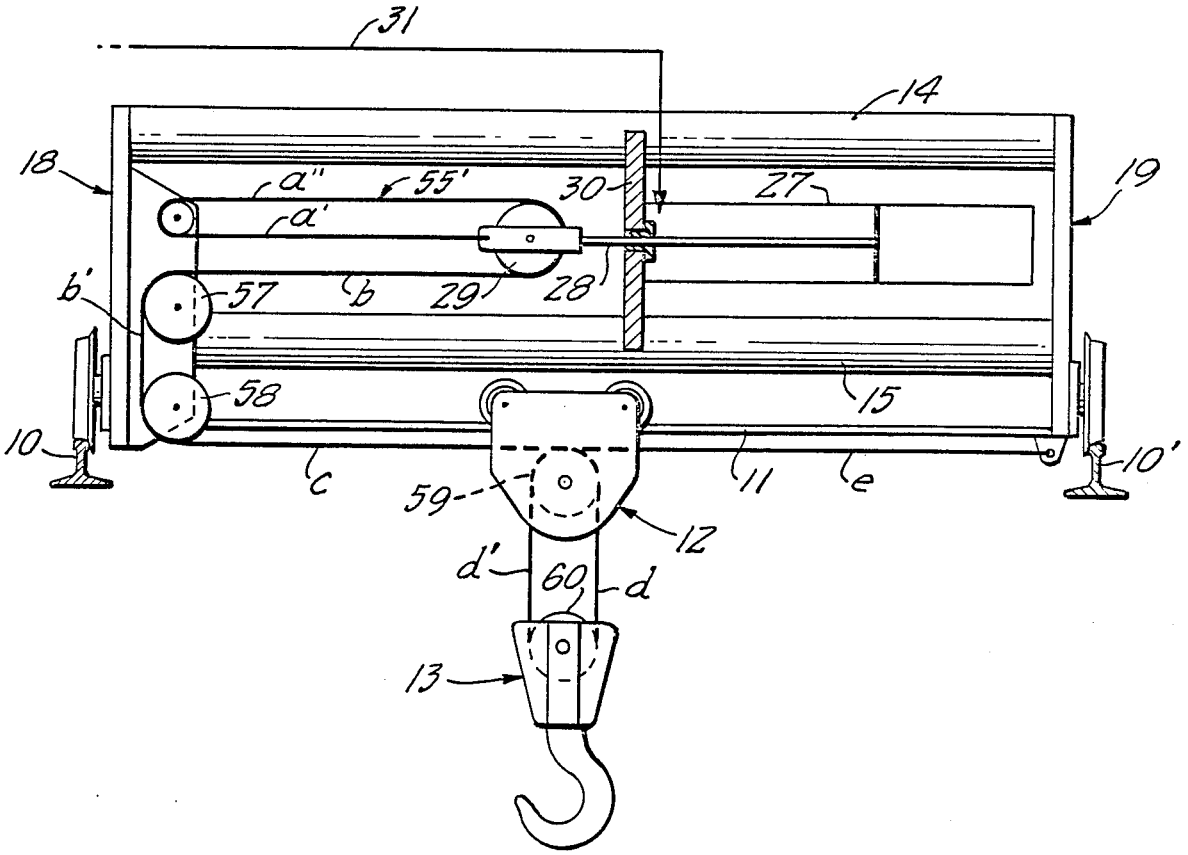
FIG. 2A is a fragmentary diagram to show a modification of part of FIG. 2.

A modified reaving arrangement is shown in FIG. 2A, wherein the cabling connection to the piston of cylinder 27 is a fixed connection to an end of the cabling. Specifically, the end of cable 55' is connected to the piston rod 28; and cable 55' runs a first course a' to a sheave 29', and a second course a to sheave 29, before proceeding over courses b to e.

A brief description may now be given for operation involving the circuit of FIG. 2. Initially, one may assume a filled system wherein hook 13, its load and the piston of traction cylinder 27 are locked at a particular elevation above floor level, by reason of motor 38 (and solenoid valve 44) shut-down, with resultant local bleed of pilot-operating fluid to sump 45, which will be understood to drain this small volume of hydraulic fluid to the reservoir 50 (via means not shown). Both check valves 33-34 are thus automatically closed, with valve 34 locking the elevated position of hook 13 and its load. It will also be understood that a charge of pressurized gas (e.g., nitrogen) will be contained with the gas volume of the accumulator, thus loading check valve 33 in its closed position.

To start from shut-down conditions, motor 38 is energized, thus driving the rotor of integrator 35 as well as pump 53. Low-pressure fluid is thus available to the servo valve 41 for such control as may be initiated upon manual actuation of handle 41'. Any such handle (41') displacement away from neutral position (1) will cause actuator to tilt the swash plate of integrator 35 and thus cause momentary pumped higher-pressure delivery of hydraulic fluid to one of the lines 33'-34', and (2) via swash-plate tilt and means 32 will actuate solenoid valve 44 to its position of admitting the higher-pressure fluid to lines 43-42 for pilot-operated opening of both of the check valves 33-34. Once these pilot-operated valves have opened, full accumulator pressure exists in line 33', and the existing hook (13) and load-reflecting traction-cylinder (27) pressure exists in line 34'; these pressures are either equal or nearly equal, depending upon the instantaneous load, but at any given time during a hoisting or a descent operation, the greater one of these pressures is overwhelmingly adequate to maintain both check valves 33-34 in open condition. Hoisting (or descent) operation continues until control means 41' is shifted back to its central (neutral) position and the swash plate has returned to its neutral position, at which point solenoid valve 44 is deactivated to relieve pilot-actuating pressure, so that valves 33-34 can close and lock the instantaneous hoisted elevation of the hook 13, whether or not loaded.

Thus, once started, and until shut-down, the hydraulic system is in readiness for the elevating/descent phases involved in hoisting operations. To raise the load, the proportional-control handle 41' of servo valve 41 is moved (from mid-position) in the direction determining an up displacement, and to the manipulated extent which is to reflect the operator's call for speed. To lower the load, the handle 41' actuation is the same, for the opposite direction of movement from mid-position. And once the desired change in load (or no-load) elevation of the hook 13 is achieved, the handle 41' is returned to mid-position, thus neutralizing fluid-displacement action of the integrator 35 and allowing both check valves 33-34 to close and lock the achieved elevation of the hook 13.

The described invention will be seen to have achieved all stated objects. The bridge structure beneficially serves both for load support and for efficient hydraulically controlled hoisting. Such great savings in weight are realized for a given-capacity system that economies can be realized in prime-mover horsepower, both for the bridge and trolley drive systems (which have not been described but which may be of conventional design) and for the prime mover 38 of the hoisting system. Except for the accumulator 25 and the actuator 27, the hydraulic-control components (FIG. 2) involve but small bulk and weight and may be easily packaged in an operator's cab (not shown) carried at one end of the bridge. A further advantageous feature is that under the involved accumulator pressure, e.g., in the order of 1500 psi, and for the involved cylinder (14, 15) sectional areas, substantial tension force is developed in each cylinder; and in the case of the upper cylinder 14, this tension force is in the direction of substantial opposition to (and therefore offset of) compressional forces attributable to gravitational and load deflection of the bridge girder.

It will be understood that certain safety and maintenance features having to do with the hydraulic system have been omitted from the present description, since they are already described in said copending application Ser. No. 601,481. However, it is important, for avoidance of loss of hydraulic fluid, to periodically restore such fluid to the system from that which accumulates at the sump. For this reason, the recycling means described in connection with FIG. 6 of said Ser. No. 601,481 is bodily incorporated, with the same reference numbers, in FIG. 2 of the present drawings. The replenishment is accomplished by a pump 103 which draws fluid from sump 50, in accordance with upper-level (105) and lower-level (106) operation of switch means 104 governing off/on operation of the pump motor 102.

While the invention has been described in detail for an illustrative embodiment, it will be understood that bridge structures of the invention may take other forms. For example, FIG. 3 illustrates that a large-capacity bridge which must also extend for a large span S, for example 100 feet or more, or with cantilevered ends extending beyond the points of rail (10, 10') support, it is desirable to provide greater stiffness against flexure of the vertical plane of symmetry of the bridge section. Thus, in FIG. 3, the bridge section is generally isosceles triangular, involving three closed elongate cylinders 60-61-62 which are of the same length, corresponding to the bridge span. The cylinders 60-61-62 will be understood to be fixed in their connection to the respective end members, such as the members 18-19 of FIGS. 1 and 2. All three cylinders are retained by welded struts 63-64, which may be of laced pattern, and they are interconnected for pressure-fluid purposes, serving pressurized-gas volume purposes of the hydraulic accumulator. The triangular spaced array of cylinders 60-61-62 is also seen in FIG. 3 to enable adequate nesting accommodation of the piston cylinder 17 and of the traction cylinder 27 within the section dimensions, and the trolley rail may be part of the nested rigid spacer structure between the two lower cylinders 61-62, although in FIG. 3, the trolley rail comprises two spaced rails 65.

What is claimed is:

1. In a crane construction wherein two transversely spaced parallel longitudinal rails are spanned by a travelling bridge with end-support means riding said rails, and a hoist trolley and hook movably supported for guided movement along said bridge, the improvement wherein said bridge comprises spaced upper and lower closed elongate cylinders defining substantially the full bridge span, said cylinders having fluid communication and coacting to define a gas-pressurized hydraulic accumulator having an outlet port for in/out flow of hydraulic fluid, rigid structure connecting said cylinders to each other and defining their spacing, the end-support means being rigidly connected to the respective ends of said cylinders, a traction cylinder and piston carried by said bridge within a fraction of said span, a reversibly controllable hydraulic-power integrator connecting said accumulator port to the tail end of said traction cylinder, and hook-suspension cabling connected to said piston via sheave means mounted to said trolley and to the one end of said bridge which faces the tail end of said traction cylinder.

2. The improvement of claim 1, in which the cabling connection to said piston is a fixed connection to an end of the cabling.

3. The improvement of claim 1, in which the cabling connection to said piston is via a sheave and in which the adjacent end of the cabling is a fixed connection to said one end of said bridge.

4. The improvement of claim 1, in which said cabling and sheave means define a cabling course involving a fixed cable connection to said one end of said bridge, and a course therefrom (1) via a first sheave connected to said piston, (2) a second sheave mounted to said one end of said bridge, (3) a third sheave mounted to said trolley, (4) a fourth sheave mounted to said hook, (5) a fifth sheave mounted to said trolley, and (6) a fixed other-end connection to the other end of said bridge.

5. The improvement of claim 4, in which said cabling course is one of a plurality of like courses in parallel relation.

6. The improvement of claim 5, in which each of said first to fifth sheaves is a single drum pulley with adjacent multiple grooves serving the respective courses of said plurality.

7. The improvement of claim 4, in which said cabling involves multiple reaving in excess of 2:1 in courses between the first and second sheave locations.

8. The improvement of claim 1, in which said hydraulic accumulator further includes a third accumulator cylinder carried by said bridge and structurally independent of the structural connection of said upper and lower cylinders, said third accumulator cylinder having a gas-connection end in fluid communication with said upper and lower cylinders and a hydraulic-fluid connection end at said outlet port, and a gas/liquid piston having movably and sealed guidance in the bore of said third accumulator cylinder.

9. The improvement of claim 1, in which said upper and lower cylinders comprise a single upper cylinder and two spaced parallel lower cylinders in rigidly connected isosceles-triangular sectional array.

10. The improvement of claim 9 in which said hydraulic accumulator further includes a fourth accumulator cylinder carried by said bridge and structurally independent of the structrural connection of said upper and lower cylinders, said fourth accumulator cylinder having a gas-connection end in fluid communication with said upper and lower cylinders and a hydraulic-fluid connection end at said outlet port, and a gas/liquid piston having movably and sealed guidance in the bore of said fourth accumulator cylinder.

11. The improvement of claim 10, in which said fourth cylinder is carried within said sectional array.

12. In a crane construction wherein two transversely spaced rails are spanned by a travelling bridge with end-support means riding said rails, and a hoist trolley and hook movably supported for guided movement along said bridge, the improvement wherein hydraulic-accumulator means including upper and lower parallel closed elongate horizontal cylinders are in fluid communication and are carried by said bridge, said cylinders being rigidly spaced from each other and connected at their ends to said end-support means to thereby contribute structural intergrity to said bridge, a traction cylinder and piston carried by said bridge within a fraction of said span, an elongate horizontal piston/cylinder having a gas connection at one end to said closed horizontal cylinders, hydraulic-circuit means comprising a reversibly controllable hydraulic-power intergrator connecting the other end of piston/-cylinder to the tail end of said traction cylinder, and hook-suspension cabling connected to said piston via sheave means mounted to said trolley and to the one end of said bridge which faces the tail end of said traction cylinder.

13. In a crane construction wherein two transversely spaced longitudinal rails are spanned by a travelling bridge with end-support means riding said rails, and a hoist trolley and hook movably supported for guided movement along said bridge, the improvement wherein said bridge is an elongate structure of high sectional moment of inertia in essentially a single vertical plane of symmetry, hydraulic-accumulator means including upper and lower closed elongate horizontal cylinders in fluid intercommunication and having positional symmetry with respect to said plane, said cylinders being rigidly spaced from each other and connected at their ends to said end-support means to thereby contribute to said high sectional moment of inertia, traction-cylinder and piston means carried by said bridge within a first fraction of said span, a reversibly controllable hydraulic-power integrator connecting said accumulator means to the tail end of said traction cylinder, and hook-suspension cabling connected to said piston via sheave means mounted to said trolley and to the one end of said bridge which faces the tail end of said traction cylinder.

14. As an article of manufacture, an elongate travelling bridge with end-support means for riding spaced parallel horizontal rails to be spanned by said bridge, said bridge comprising spaced upper and lower closed elongate cylinders defining substantially the full bridge span, hydraulic-accumulator means having a gas-pressurized volume, said cylinders having fluid communication and coating to define substantially the entire gas-pressure volume of said hydraulic-accumulator means, means rigidly connecting said cylinders to each other and defining their spacing, the end-support means being rigidly connected to the respective ends of said cylinders, a traction cylinder and piston carried by said bridge within a first fraction of said span, the tail end of said piston having externally accessible means of cable connection, an elongate piston/cylinder having a gas connection at one end to one of said upper and lower cylinders, and hydraulic-circuit means comprising a reversibly controllable hydraulic power integrator connecting the other end of said piston/cylinder to the tail end of said traction cylinder.

15. The article of claim 14, in which the number of said closed elongate cylinders is two, rigidly connected in vertically spaced relation to define said bridge as essentially a single truss.

16. The article of claim 14, in which the number of said closed elongate cylinders is three, rigidly connected in isosceles-triangle sectional array, wherein one of said closed elongate cylinders is on a vertical plane of symmetry of said bridge and wherein the other two of said closed elongate cylinders are at equal and opposite horizontal offsets from said vertical plane of symmetry.

* * * * *